US006694762B1

(12) United States Patent
Osborne

(10) Patent No.: US 6,694,762 B1
(45) Date of Patent: Feb. 24, 2004

(54) TEMPERATURE-CONTROLLED PARALLEL EVAPORATORS REFRIGERATION SYSTEM AND METHOD

(76) Inventor: Roger K. Osborne, 12277 SW. 55th St. #912, Cooper City, FL (US) 33330

( * ) Notice: Subject to any disclaimer, the term of this patent is extended or adjusted under 35 U.S.C. 154(b) by 0 days.

(21) Appl. No.: 10/368,083

(22) Filed: Feb. 18, 2003

(51) Int. Cl.[7] ..... F25B 5/00
(52) U.S. Cl. ..... 62/199; 62/217
(58) Field of Search ..... 62/199, 200, 217, 62/229, 504, 525

(56) References Cited

U.S. PATENT DOCUMENTS 4,184,341 A 1/1980 Friedman
4,439,997 A 4/1984 Cantley
4,679,404 A 7/1987 Alsenz
4,766,735 A * 8/1988 Gotou ..... 62/175
4,779,425 A * 10/1988 Sasaki et al. ..... 62/199
4,926,652 A * 5/1990 Kitamoto ..... 62/175
4,932,220 A * 6/1990 Inoue ..... 62/175
5,709,097 A * 1/1998 Kim et al. ..... 62/206
6,578,374 B2 * 6/2003 Singh et al. ..... 62/200

* cited by examiner

*Primary Examiner*—Marc Norman
(74) *Attorney, Agent, or Firm*—Alvin S. Blum

(57) ABSTRACT

A refrigeration system provides one or more compressors, a condenser, and a plurality of evaporator coils fed with the liquid refrigerant from the condenser. Each coil is disposed in a chamber to be held at a particular low temperature by blowing air over the coil as liquid refrigerant in the coil evaporates to gas, with the absorption of heat. Each coil returns gas refrigerant back to the compressor(s) through an individual gas return line. A temperature sensor in each chamber provides an output signal related to the temperature provided by the coil. A controller receives each output signal. An on/off valve in each gas return line is controlled by the controller in response to the sensor signal to stop refrigerant flow through its respective coil when the temperature goes below a preset level and allows refrigerant flow when temperature is above a preset value. The on/off valve may be part of a conventional evaporator pressure regulator in which the regulator is adjusted wide open.

11 Claims, 3 Drawing Sheets

TEMPERATURE-CONTROLLED PARALLEL EVAPORATORS REFRIGERATION SYSTEM AND METHOD

This invention relates to refrigeration systems for cooling multiple chambers, and more particularly to apparatus and method for chamber temperature control by on/off control of refrigerant flow through individual evaporator coils in the chambers.

BACKGROUND OF THE INVENTION

Commercial refrigeration systems are used for cooling multiple chambers such as in supermarkets wherein individual chambers must be kept at various temperatures from −40 degrees to about 50 degrees F. for proper food storage. These systems generally employ many compressors in parallel. The compressed refrigerant is condensed to a liquid in a condenser. The liquid refrigerant is then fed to individual evaporator coils in the various chambers, where the liquid refrigerant evaporates to the gaseous state with absorption of heat. A blower blows air through the cooling coil and the cooled air then cools the chamber. The refrigerant gas then returns through the return gas line to the compressors. Control of the amount of cooling by each individual coil is generally by means of an evaporator pressure regulator (EPR) in each return gas line that meters the flow rate of gas. It adjusts the flow of gas to maintain a suction pressure selected across the valve to maintain a selected temperature for the chamber. The system is arranged to start and stop selected compressors to maintain a particular gas pressure at the input to the compressor bank to idle unneeded compressors for economy of operation. Some EPRs are equipped with an on/off solenoid valve to stop the flow of refrigerant during defrosting. Applicant has found that these systems of the prior art lack efficiency of operation and fail to regulate temperature accurately.

SUMMARY OF THE INVENTION

It is an accordingly an object of the invention to provide refrigeration systems that control cooling more accurately and more efficiently than conventional systems. It is another object that the system not rely upon EPRs for control of cooling. It is yet another object that control of refrigerant flow be by on/off valve in each gas refrigerant line leaving each coil. It is yet another object of the invention to provide a method of modifying a conventional refrigerator system that has EPRs with on/off valves by adjusting the EPRs to wide open and operating the on/off valve with a controller that turns the on/off valve on or off on the basis of the temperature sensed at the coil. These and other objects, features, and advantages of the invention will become more apparent when the detailed description is studied in conjunction with the drawings in which like elements are designated by like reference characters in the various drawing figures.

DETAILED DESCRIPTION OF PREFERRED EMBODIMENTS

Figure 1:
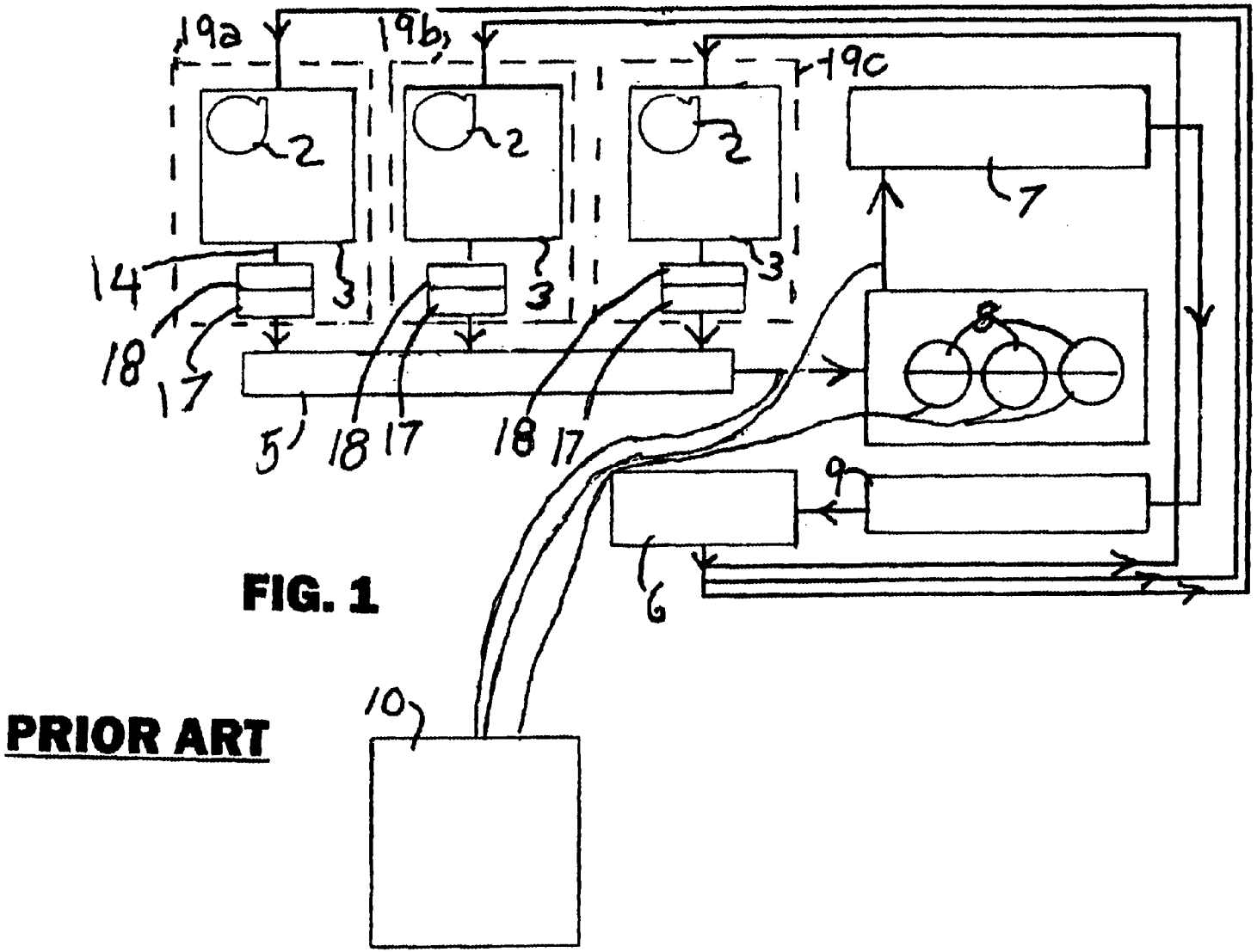
FIG. 1 PRIOR ART
FIG. 1 is a schematic diagram of a refrigeration system of the prior art.

Referring now to drawing FIG. 1, a refrigeration system of the prior art is shown having chambers 19*a*, 19*b*, and 19*c* cooled by blower fans 2 blowing over evaporator coils 3. A parallel array of compressors 8 compresses the refrigerant gas. The hot gas is cooled in air or water cooled condenser 6 where it condenses to a liquid. The liquid refrigerant is received in receiver 9. From there it passes to liquid header 6 where it is distributed to the refrigerant liquid input lines 13 to each evaporator coil 3. The liquid evaporates to a gas in the coil with absorption of heat from the air blown over the coil by fan 2, thereby cooling the chambers. The gas output lines 14 feed gas to the suction header 5 to return to the compressors 8. A controller 10 may be employed to turn particular compressors on and off to maintain a particular pressure differential between input and output to the compressors for efficient use of power as disclosed in U.S. Pat. No. 4,184,341 issued Jan. 22, 1980 to Freedman. An evaporator pressure regulator (EPR) 17 is often used in the gas line 14 to control the rate of flow of refrigerant by maintaining a preset pressure differential across it that is adjusted to deliver a particular temperature from the coil. The EPR valve 17 is often supplied with a solenoid on/off valve 18 for cutting of refrigerant flow while the coil is being defrosted.

Figure 2:
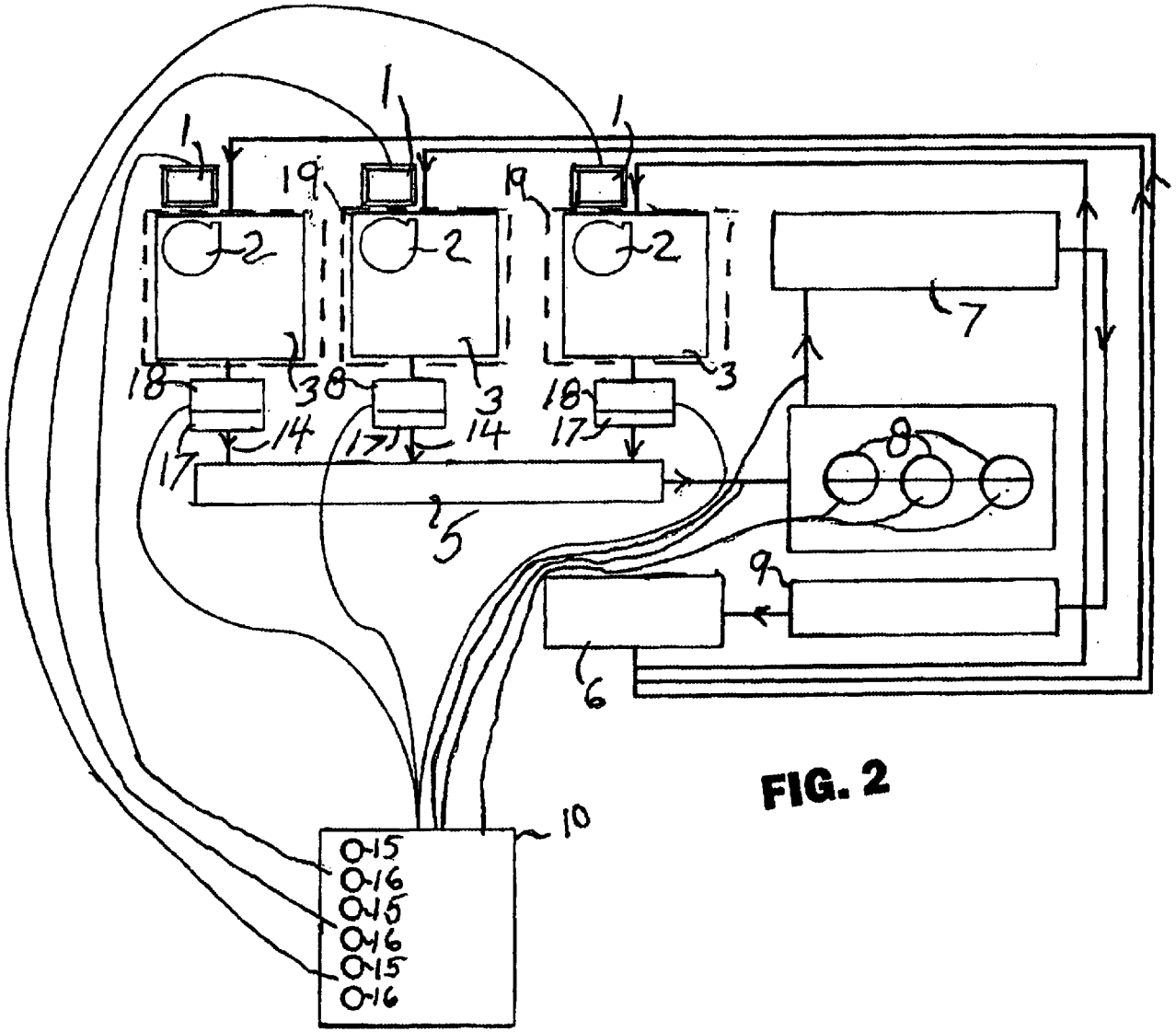
FIG. 2 is a schematic diagram of the refrigeration system of FIG. 1 modified by the invention.

Applicant has found that he could greatly improve both energy efficiency and accuracy of temperature regulation by modifying the system of FIG. 1. Referring now to FIG. 2, the method of modifying the system comprises setting the EPR valve 17 wide open so that it has no effect on refrigerant flow. A temperature sensor 1 for sensing the cooling air in each chamber feeds an electrical signal to the controller 10 that may be a microprocessor or computer, for example. In the controller a low setting 15 and a high setting 16 is provided for actuating each on/off valve 18 so that the gas flow through each line 14 is opened at a preset high temperature and closed at a preset low temperature as set by the adjustments 61 and 15 respectively.

Figure 3:
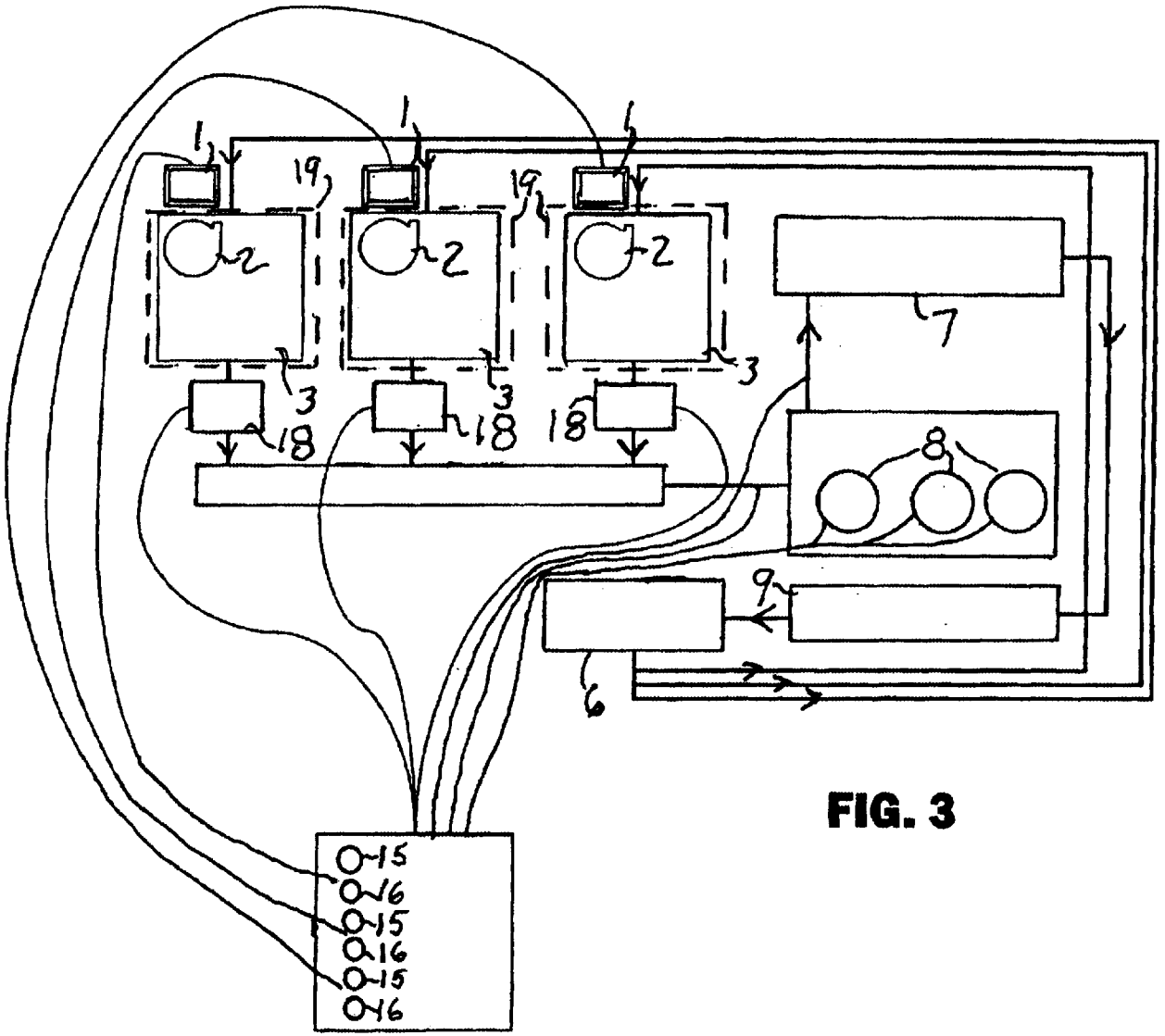
FIG. 3 is a schematic diagram of another embodiment of the invention.

Referring now to FIG. 3, another embodiment of the invention is shown in which a separate on/off valve 18' is shown with no EPR valve, since none is needed. This enables the use of a valve that is most suitable for the many operating cycles it must endure.

While I have shown and described the preferred embodiments of my invention, it will be understood that the invention may be embodied otherwise than as herein specifically illustrated or described, and that certain changes in form and arrangement of parts and the specific manner of practicing the invention may be made within the underlying idea or principles of the invention.

What is claimed is:

1. In a refrigeration system having at least one compressor and condenser for supplying liquid refrigerant, and a plurality of evaporator coils, the coils disposed in a plurality of chambers for maintaining a preset temperature in each chamber, each coil receiving liquid refrigerant and returning gas refrigerant through an individual refrigerant line, the improvement comprising:

a) a controller;

b) a temperature sensor disposed in each chamber providing an output signal to the controller related to the temperature being provided by the coil;

c) a plurality of on/off valves, one on/off valve in the returning gas refrigerant line connected to each coil, each valve operatively controlled by the controller for enabling the flow of refrigerant through the coil in a first mode of operation, and for obstructing the flow of refrigerant in a second mode of operation; and d) the controller being provided with means for presetting the operating mode of each valve based on the signal received from the temperature sensor associated with its respective coil, so that in the first mode the coil receives refrigerant flow when the sensor indicates that the temperature sensed is above a preset value, and in the second mode the coil does not receive refrigerant flow when the temperature sensed is below a preset temperature.

2. The system according to claim 1 in which there is a plurality of compressors connected in parallel, and the controller is adapted for operating selected compressors based on the requirements of the system.

3. The system according to claim 1 in which the controller is electronic and the signals from the sensors are electrical.

4. The system according to claim 1 in which the controller is pneumatic.

5. The system according to claim 1 in which the controller is hydraulic.

6. In a refrigeration system having a plurality of compressors connected in parallel and a condenser for supplying liquid refrigerant to a plurality of evaporator coils, the coils disposed in a plurality of chambers for maintaining a preset temperature in each chamber, each coil receiving liquid refrigerant and returning gas refrigerant through an individual refrigerant line, the improvement comprising:

a) an electronic controller;

b) a temperature sensor disposed in each chamber providing an output electric signal to the controller related to the temperature being provided by the coil;

c) a plurality of on/off valves, one on/off valve in the returning gas refrigerant line connected to each coil, each valve operatively controlled by the controller for enabling the flow of refrigerant through the coil in a first mode of operation, and for obstructing the flow of refrigerant in a second mode of operation;

d) the controller being provided with means for presetting the operating mode of each valve based on the signal received from the temperature sensor associated with its respective coil, so that in the first mode the coil receives refrigerant flow when the sensor indicates that the temperature sensed is above a preset value, and in the second mode the coil does not receive refrigerant flow when the temperature sensed is below a preset temperature; and e) the controller adapted for controlling operation of selected compressors based on the system requirements.

7. The system according to claim 6 in which the on/of valve is part of an evaporator pressure regulator that is set wide open.

8. A method of controlling the temperatures in refrigerated chambers in a refrigeration system having a plurality of compressors connected in parallel and a condenser for supplying liquid refrigerant to a plurality of evaporator coils, the coils disposed in a plurality of said chambers for maintaining a preset temperature in each chamber, each coil receiving liquid refrigerant from an individual liquid refrigerant line and returning gas refrigerant through an evaporator pressure regulator in an individual gas refrigerant line, the method comprising:

a) providing a temperature sensor disposed in each chamber providing an output signal related to the temperature being provided by the coil;

b) providing a controller for receiving the output signal from each sensor;

c) adjusting each evaporator pressure regulator wide open;

d) connecting the controller to an on/off valve in each individual gas refrigerant; and f) providing the controller with means for presetting the operating mode of each valve based on the signal received from the temperature sensor associated with its respective coil, so that in the first mode the coil receives refrigerant flow when the sensor indicates that the temperature sensed is above a preset value, and in the second mode the coil does not receive refrigerant flow when the temperature sensed is below a preset temperature.

9. The method according to claim 8 further comprising adapting the controller for controlling operation of selected compressors based on the system requirements.

10. The method according to claim 9 in which the on/off valve is integral with the evaporator pressure regulator.

11. The method according to claim 8 in which the on/off valve is integral with the evaporator pressure regulator.

* * * * *